US007204063B2

(12) United States Patent
Kandalgaonkar

(10) Patent No.: US 7,204,063 B2
(45) Date of Patent: Apr. 17, 2007

(54) ROOFING SHINGLE WITH HEADLAP SEAL AND IMPROVED COVERAGE

(75) Inventor: Jayant B. Kandalgaonkar, Dorval (CA)

(73) Assignees: EMCO Building Products Corp., Lasalle, Quebec (CA); EMCO Materiaux de Construction Ltee, Lasalle, Quebec (CA)

( * ) Notice: Subject to any disclaimer, the term of this patent is extended or adjusted under 35 U.S.C. 154(b) by 15 days.

(21) Appl. No.: 10/704,757

(22) Filed: Nov. 12, 2003

(65) Prior Publication Data

US 2004/0206035 A1 Oct. 21, 2004

(30) Foreign Application Priority Data

Apr. 17, 2003 (CA) ..... 2425726

(51) Int. Cl.
*E04D 1/26* (2006.01)

(52) U.S. Cl. ..... 52/551; 52/559; 52/523; 52/420; 428/143

(58) Field of Classification Search ..... 52/518, 52/523–526, 551–552, 555, 559, 420, 546, 52/748.1, 516, 105; 428/352–356, 489, 491, 428/143

See application file for complete search history.

(56) References Cited

U.S. PATENT DOCUMENTS 2,863,405 A * 12/1958 Leibrook et al. ..... 52/420
3,903,340 A * 9/1975 Shepherd ..... 428/77
4,333,279 A * 6/1982 Corbin et al. ..... 52/105
4,559,267 A * 12/1985 Freshwater et al. ..... 428/352
4,637,191 A * 1/1987 Smith ..... 52/522
4,824,880 A * 4/1989 Algrim et al. ..... 524/62
4,856,251 A 8/1989 Buck
5,488,807 A * 2/1996 Terrenzio et al. ..... 52/555
5,950,387 A * 9/1999 Stahl et al. ..... 52/559
6,199,338 B1 * 3/2001 Hudson et al. ..... 52/518
6,228,785 B1 5/2001 Miller et al.

FOREIGN PATENT DOCUMENTS

CA 403975 4/1942
CA 644823 7/1962
CA 791912 8/1968
CA 900136 5/1972

OTHER PUBLICATIONS

Verlegevorschrift Isola Dachschindeln; brochure from Isola-Platon GmbH; no date available.
Itseliimautuvat ICOPAL KONTAKT katelaatat; brochure from Isola-Bitumenschindeln; no date available.
Materialdaten Isola Schindel; brochure from Isola-Platon GmbH; no date available.
Isola Schindel; brochure from Isola-Platon GmbH; no date available.

* cited by examiner

*Primary Examiner*—Winnie Yip
(74) *Attorney, Agent, or Firm*—Nixon & Vanderhye, PC

(57) ABSTRACT

A roofing shingle for enhanced wind/rain durability embodies two transverse lines of adhesion. A first discontinuous line of adhesive joins the butt edge of an overlying shingle to the underlying shingle. Secondly, a band of sealant adjacent the top edge of an underlying shingle seals against an overlying shingle to prevent penetration by wind driven rain to the roof deck. A reduced headlap is thereby permitted, thereby either reducing shingle size or extending shingle coverage. Exposed portions of the sealant band improve the erosion resistance of underlying shingles.

45 Claims, 2 Drawing Sheets

ROOFING SHINGLE WITH HEADLAP SEAL AND IMPROVED COVERAGE

FIELD OF THE INVENTION

The present invention relates to the art of roofing shingles and in particular to roofing shingles that must withstand exposure to high winds and driving rain as well as pooling water arising from ice damming. This invention relates generally to an improved roofing shingle and its use in a roofing system which exhibits superior resistance to wind driven rain. The shingle of the present invention embodies adhesive sealant elements located in specific areas to achieve a more unified, integral roof shingle system adapted to substantially withstand and shed wind driven rain. A corollary benefit of the present invention is the ability to reduce the standard requirement of a two inch headlap, resulting in substantially greater coverage for the same shingle quantities and lower labour costs, all without degrading the structural integrity and performance of the roofing shingle system.

BACKGROUND OF THE INVENTION

Traditional granular surfaced roofing shingles are well known. Such shingles generally have been made with a substrate which may constitute organic fibre saturated with bitumen, or chopped glass fibre bonded with urea-formaldehyde or other types of resins. Typically, the substrate is first coated with a mixture of bitumen and filler such as limestone, or similar inorganic fillers. The coated substrate then is covered with mineral granules which may be coloured to give aesthetic appeal to the face of the shingles. A parting agent is applied to the back of the substrate so that the packaged shingles do not stick together. In some cases, a bitumenous sealant is also placed on the granulated side of the shingles to enhance adhesion to the back of covering shingles in the final applied configuration. Typically on conventional shingles, such bitumenous sealant is a stitched or interrupted line of sealant positioned generally adjacent the horizontal midpoint of the shingle, (i.e., in a tabbed shingle, above any cut-out between tabs).

Many variations of this typical shingle system have been disclosed. Fasold Canadian patent 644,823 discloses a release tape in contact with the adhesive strip of an adjacent shingle in a shingle stack of sequentially reversed shingles whereby the release tape would not contact the adhesive when the shingles are installed. Kirschbraun Canadian patent 403,975 discloses a fugitive release material, such as salt, to inhibit premature sealing of the adhesive in stacked shingles. Burtch Canadian patent 900,136 discloses a sinuous adhesive pattern applied by hand during the installation of a roof system. Corbin Canadian patent 900,136 discloses an adhesive strip on the underside of a shingle, to adhere the head of the shingle to the roof deck. Buck U.S. Pat. No. 4,856,251 discloses a self-gauging partial two-ply shingle with a standard stitch adhesive strip at the tab and a solid adhesive strip located at the rear edge of the shingle.

One typical shingle is a "three tab" shingle, in which the shingle sheet has two full cut-outs and half cut-outs at each side edge defining three tabs or flaps which, on a finished roof, resemble individual shingles. Other shingles may have multiple tabs, or no tabs (i.e., slab shingles). Still other common shingles are laminated or overlay shingles which may not have cut-outs.

Again, typically a bead or strip of temperature sensitive adhesive or sealant such as a bitumenous compound, is applied to either the upper or the lower surface of the shingle, in a location such that the bead or strip is located beneath the butt end of the flaps of an installed overlying shingle. Under conditions of heat, the bitumenous compound adheres the butt edge of a flap to the surface of an underlying shingle. This line of adhesive is "stitched" leaving intermittent gaps, to permit drainage of any moisture which may condense or be driven under the shingle, either at a lateral joint between adjacent shingles, at the tab cut-outs or the lateral edge of a roofing.

Certain building codes, such as the International Residential Building Code, the South Florida Building Code, and specifically the Dade County Building Code have raised the performance requirements of roofing products. In the case of Dade County, the code requires any system of bitumenous roofing shingles not only to resist hurricane wind forces as high as 110 mph, but also resist such wind driven rain. Similar codes are being adopted by several States in the USA that are prone to high wind and rain damage. These are generally located in the coastal regions of the USA.

Current shingles have a built-in weakness, namely the shingle tab adhesive compound is applied in a "stitch" or intermittent pattern (as opposed to a continuous strip of adhesive along the length of the shingle). Consequently, sufficiently high velocity wind and rain can enter the gaps between the adhesive elements and can lift the overlaying second layer of shingle tabs. If the forces of wind and rain are sufficiently strong, or if the bond between the adhesive "elements" adhering to the shingle tabs are weak, the tabs will lift, and sometimes blow off. If rain is driven under the overlying shingles or through the stitch gaps and penetrates between the shingles sufficiently to exceed the "headlap", it overflows the top or head edge of the underlying shingles and spills onto the roof deck. Headlap is commonly known as the shortest distance from the horizontal top edge of a shingle to the nearest exposed area of that shingle. In conventional tab shingles, the headlap distance from the apex of a cut-out to the top edge of a shingle is normally 2".

When shingle damage is done, rainwater can easily damage the wooden deck and subsequently the interior of the building. To avoid such potential damage, the South Florida Building Code has issued a mandatory roofing shingle application procedure in which two layers of 30# bitumen impregnated or suitable "underlayment" membranes are nailed down with specific nails/metal washers in a very defined manner. The factory made roofing shingles are nailed upon this underlayment.

Industry relies on the underlayment to provide the protection against wind driven rain. Thus, should the shingle sealant tabs break loose from the adhesive, the barrier of the underlayment (if nailed per the code) prevents further damage to the roof.

The present invention provides a continuous band of sealant along the length of the shingles, parallel to the long edges and about twice the exposed width (as specified by the manufacturer) of the shingle from the lower edge. This sealant strip is a physical barrier to the upward flow of water.

Contrary to the shingle and underlayment system required under the South Florida Building Code, it is anticipated that in the present invention the sealed shingles themselves will provide adequate resistance to the wind driven rain, without the necessity of underlayment.

In addition, the present invention can be utilized to increase the exposed area of the same shingle. This is an economic advantage to the manufacturer as well as to the roofing contractor and consequently the owner of the roof.

The rationale in favour of larger exposure area is as follows:

The current ASTM D225-01, D3462-02, CSA 123-1, CSA 123-51, CSA 123-5, European EN544, prescribe that the size of the shingle and specifically the width/depth of the shingle (shorter dimension) must be such that when shingles are nailed on the roof, there will be a minimum of 2" (51 mm) of headlap (see FIG. 1).

The fundamental intent of this mandatory requirement is based on the premise that if wind-driven rain were to travel upward on the underlying shingle from the exposed area, then, in order to prevent this forced rain water from going over the head or top edge of the underlying shingle, it would have to travel a minimum distance of 2" (51 mm). This is considered adequate under most weather conditions.

This particular requirement is critical for overlaying shingles that have "cut-outs" that allow forced rainwater to travel towards the head edge of the underlying shingle. Joints between shingles are also considered as entry points, especially when the width of the cut-out is wider, such as ½" or more. In such a case, this requirement is critical as the volume of rainwater is greater in a wider cut-out as opposed to narrower (than ½") cut-outs.

The general industry accepted formula for a shingle width (depth) is:

2× exposure+2" (51 mm) headlap, where "exposure" is the portion of the shingle not covered by an overlying shingle, (which is often the same as the length of the cut-outs in a tabbed shingle).

Part of the above referenced 2" (51 mm) headlap requirement becomes unnecessary if the upward travel of the wind forced rainwater is blocked off by a continuous strip (bead or band) of factory applied sealant on the face of the shingle.

Thus, for example, when a band of sealant is applied in the area about two times the "exposure" from the butt edge of a shingle, it seals the path of potential rainwater entry. Consequently, the traditional 2" headlap is unnecessary. This excess shingle material of the headlap can simply be eliminated, resulting in a reduction in shingle material for the same coverage. Alternatively, if the same physical size of shingle is retained, the headlap can be reduced and the bead of sealant can be located near the top edge of the shingle. This provides a wider exposed surface for each shingle. Consequently, the larger exposure means a fewer number of shingles would be required to cover a unit area.

SUMMARY OF THE INVENTION

From the foregoing perspective, the present invention addresses the substantial elimination of moisture penetration under the shingles and onto the roof deck by providing a continuous sealant barrier near the top or head edge of each shingle. This sealant barrier, which operates in conjunction with the typical stitched adhesive strip, creates a stiffer, more integral roofing shingle system, thereby reducing the lifting of tabs and the consequent entry of moisture through the first stitched adhesive strip. The sealant barrier of the invention is continuous, thereby preventing water from reaching the head edge of the shingles, even excluding moisture which may enter at the cut-out of a tabbed shingle.

In one aspect of the present invention, a monoplanar roofing shingle, (having a generally uniform thickness) with a tab or flap portion and main body portion, has a conventional stitched or intermittent adhesive strip located just above the line of the apices or top ends of the cut-outs between the tabs. That adhesive strip adheres the tabs of an overlying shingle. More importantly, a continuous sealant strip is applied to the shingle surface near the top or head edge, but spaced sufficiently therefrom to prevent bleeding over the edge. The precise position of the second adhesive strip is important to the full attainment of a barrier seal. In the shingle of the present invention, the second sealant strip is positioned above (towards the head or top edge of the shingle) a hypothetical line located above the exposure of the shingle by an amount equal to the width of the exposure. In the parlance of the industry, the sealant strip would be 2× exposure from the butt edge of the shingle. In a preferred embodiment of the invention, the lower edge of the second sealant strip extends below the hypothetical line whereby the apex of the cut-out of an overlying shingle is sealed within the second sealant strip. In a tabbed shingle, the second sealant strip is similarly located above the butt edge a distance equal to 2× the "exposure", or cut-out length.

A further aspect of the invention is that the width of the shingle of the invention may be reduced, or the coverage of the shingle increased, relative to a traditional shingle having a width of 2× exposure+2".

In still a further aspect of the shingle of the present invention, a novel side gauging notch permits the shingles to be selectively installed with a traditional 2" headlap, or alternatively to utilize the advantageous extended coverage aspect of the present invention.

BRIEF DESCRIPTION OF THE DRAWINGS

An embodiment of the present invention will now be described, presented by way of example only with reference to the accompanying drawings in which.

DETAILED DESCRIPTION OF PREFERRED EMBODIMENTS OF THE INVENTION

Figure 1:
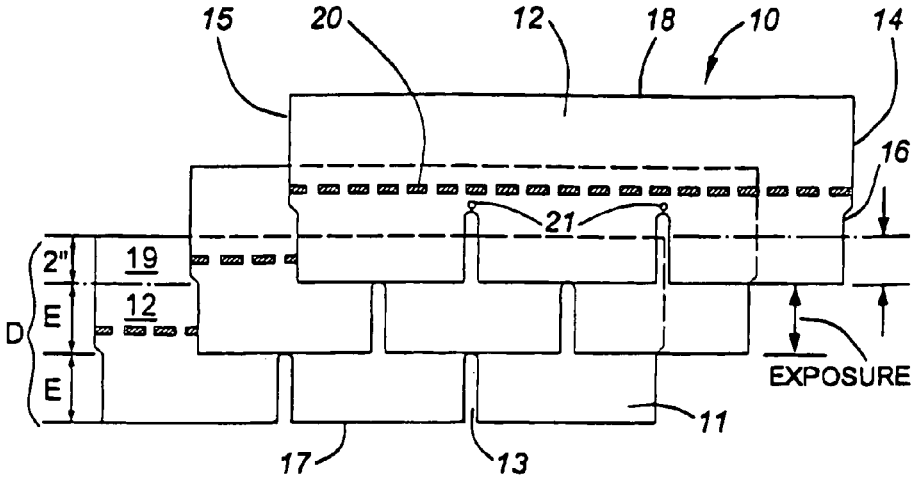
(PRIOR ART) FIG. 1
FIG. 1 is a plan view of a conventional shingle system.

A conventional roofing arrangement comprising a number of overlapping tabbed shingles as illustrated in FIG. 1. Shingles 10 are generally monoplanar and have a tab or flap portion 11 and a main body portion 12. In the three tab shingle illustrated in FIG. 1, there are two cut-outs 13 intermediate the side edges 14 and 15, and semi cut-outs 16 at each side edge. A butt edge 17 and a top edge 18 define the width of the shingle. In accordance with both ASTM and CSA standards, the width of the shingle is equal to 2× the exposure (i.e., the length (E) of cut-outs 13, plus 2" or 50 mm, i.e. D=2 E+2".

As may be seen from FIG. 1, the lower tab portion 11 of each shingle is exposed while the upper, covered portion 12 is covered by an overlying shingle. In the shingle system illustrated, a third topmost shingle overlies portions of two lower shingles creating a 2" band 19 of three shingle plies. The band 19 on the lowermost shingle is referred to as the "headlap" (i.e., the shortest distance from the upper edge to the shingle to the exposed area of the shingle in the cut-out of the overlying shingle). Additionally, interrupted or stitched band of sealant 20 is applied to the shingle 10 along a line above the "exposure", and above the apex of the cut-outs in the conventional manner. The sealant serves to adhere the tabs of an overlying shingle and prevent them from lifting in a wind. Finally, the shingles are typically nailed or stapled to the decking below at a point approximately ¼" to ½" above the apex of the cut-out such as at 21. This is often marked as a "nailing strip".

In adverse weather conditions, rain and other moisture can penetrate under the butt edge of an overlying shingle. In the most severe case, wind driven rain may penetrate under a shingle at the apex and adjoining sides of the cut-out. At that point, given sufficient wind pressure, the water can migrate upwardly. If it migrates upwardly by 2", it will exceed the extent of the 2" headlap 19, pass over the top edge 18 of the shingle beneath and reach the roof deck. In the absence of any underlayment, the roof deck will then be wetted.

Figure 2:
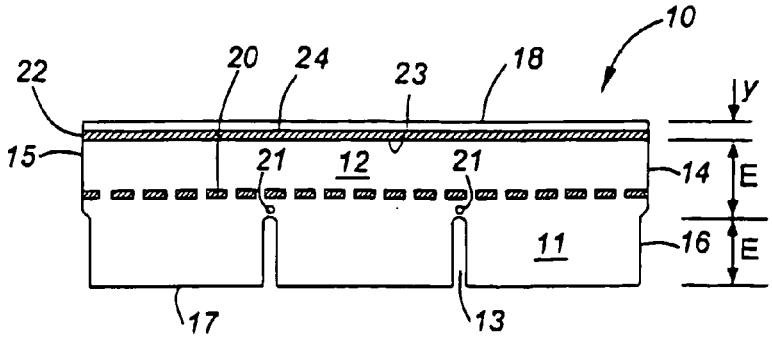
FIG. 2 is a plan view of a shingle in accordance with the present invention.

The wetting problem described above is addressed by the shingle of the present invention, illustrated in FIG. 2. A three tab shingle may be seen from FIG. 2, where the shingle 10 has tab portions 11, main body 12 with cut-outs 13 defining the flaps. Side edges 14 and 15, which define the length of the shingle, include semi cut-outs 16 on either side. A butt edge 17 and top edge 18 define the width of the shingle. A conventional stitched adhesive strip 20 is located somewhat above the apex of the cut-outs 13. Such a typical shingle would be attached by fasteners, such as nails 21 or other similar means.

Novel to the present invention, however, is a continuous sealant strip or band 22. The lower edge 23 of the band 22 is located a distance from the butt edge 17 of the shingle equal to twice the exposure length (E) of the cut-out 13 (i.e. 2×E). The band may be ¼" to 2" wide, preferably about ½" to ¾" wide. The upper edge 24 of the band 22 does not extend to the top edge of the shingle, and is preferably about ¼" from the top edge in order to prevent signifiacant bleeding of sealant over the top edge. It will be understood that the tabbed shingle of FIG. 2 is exemplary only, and the sealant band 22 can also be employed on a non-tabbed, multi-layered or slab shingle.

Figure 3:
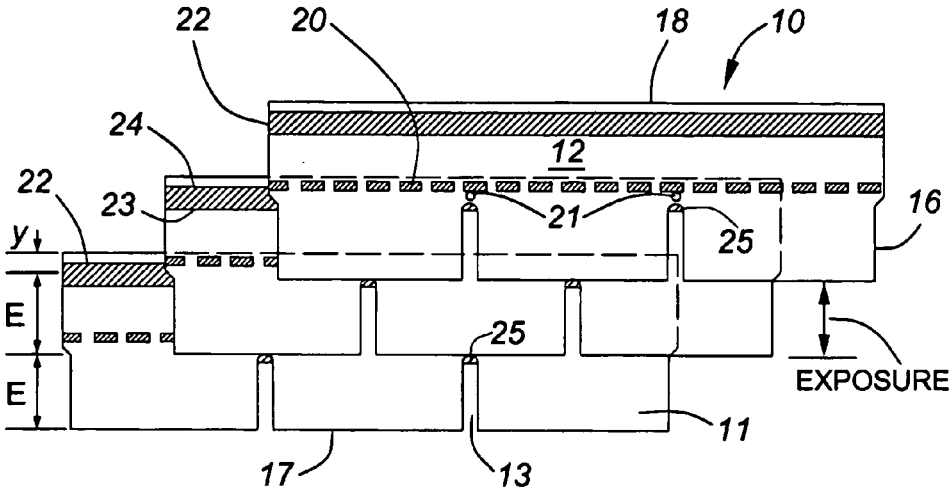
FIG. 3 is a plan of the partial shingle system of the present invention.

A preferred embodiment of the invention is illustrated in FIG. 3. The tabbed shingle is the same as FIG. 2 and has a butt edge 17 and top edge 18, and a stitched adhesive strip 20 as in FIG. 2. The continuous sealant band 22, however, is wider, such that the lower edge 23 of the band 22 extends somewhat lower than illustrated in FIG. 2, i.e. it is less than 2×E from the butt edge 17. The top edge 24 is located in the same position as in FIG. 2, thereby providing a wider band 22.

The preferred embodiment of the invention illustrated in FIG. 3, where the continuous upper sealing strip 22 is a wider band, and provides an extremely reliable continuous sealant barrier against the passage of any moisture which may penetrate under the butt edge or even at the cut-out sides or apex of the overlying shingle. Furthermore, being of a more generous width, it creates a reservoir of sealant which bridges the gap at the joint between side edges of laterally adjacent shingles. Finally, the broader width of band 22 permits the nails or staples 21 in an overlying shingle, to pass through the sealant band of the underlying shingle, thereby sealing around the shank of the nail itself.

As may be seen from FIG. 3, with the wider band 22, a portion 25 of the lower edge 24 of band 22 will be visible at the apex of the cut-out 13 of an overlying shingle. This visible portion 25 serves to enhance the erosion resistance of the shingle at a critical point for erosion. Cascading rainwater is one of the primary factors in shingle deterioration. It is particularly severe at the cut-out apex. Added erosion resistance at this point will significantly enhance shingle life.

As may be seen in FIGS. 2, and 3, the shingle 10 has a depth equal to 2× the exposure or cut-out length (i.e. 2 E) plus a headlap distance (Y). As noted previously in conventional shingles, with a headlap of 2", if rain penetrates beyond the 2" headlap, the roof deck gets wet. In the shingle of the present invention, the headlap distance is less than 2". Typically, the distance Y may be anywhere between ¼" and 1". This is adequate to provide a headlap whereby the nail 21 in the overlying shingle passes through the headlap Y of the underlying shingle.

EXAMPLE 1

In the United States and Canada, wind and rain penetration has been the subject matter of numerous building codes. Dade County, in Florida, and the Canadian Construction Materials Centre have established the highest standards, requiring that shingles withstand wind and rain penetration to 110 mph (175 kph). Other organizations, such as ASTM and CSA, merely require that shingles resist wind uplift (stitch failure) up to 60 mph (90 kph).

In dynamic tests conducted by the applicant, conventional three tab shingles installed conventionally, (5⅝" exposure with 2" headlap) with only the tab stitch adhesive, passed the standard ASTM/CSA wind uplift test as no tabs failed under winds of 60 mph (90 kph). Nonetheless, the same three tab shingles experienced rain penetration under a wind and rain loading of 50 mph (80 kph). Only an underlayment would have retarded consequent water damage.

In contrast, dynamic tests of shingles of the present invention, with increased exposure (6⅛" vs. 5⅝") and reduced headlap (1" vs. traditional 2") with the addition of a ½" continuous sealant barrier positioned ¼" from the top edge of the shingle, withstood wind and rain loading to such an extent that substantially no rain was able to penetrate in hurricane force winds of 110 mph (175 kph). No underlayment was required by this roof in order to meet the Dade County or CCMC wind/rain criteria.

This new shingle, utilizing the moisture barrier qualities of sealant band 22, permits a lesser shingle depth; (i.e. the 2" non-sealed headlap of the traditional shingle may be reduced, for example, to 1" headlap), but with enormously increased moisture retardance. This has the effect of allowing a smaller (narrower width) shingle, with consequent material cost savings, or allowing a regular size shingle to cover a greater area, with consequent material and labour savings.

EXAMPLE 2

For a shingle having a 5" exposure (E) by a 36" length, in order to cover 100 square feet of roof, 80 shingles would be required.

i.e.100÷(5"×36"/144)=80

However, in the present invention, with a sealant band and reduced headlap, the same shingle could increase exposure to 5½". The number of shingles required to cover 100 square feet of roof would be approximately 73, i.e. 100÷(5.5"×36"/144)=72.73.

This approach allows the same coverage of roof with some seven fewer shingles (approximately 10%). Conversely, one could choose not to increase the exposure of the shingles, but could reduce the width of the shingle by the same amount of 1" which would also allow a reduction in raw material consumption. With increased coverage, fewer shingles need be applied and both time and labour costs are reduced. Consequently, there is a clear economic benefit for the manufacturer, roofing applicators (contractors), and ultimately consumers (home owners). This economic benefit is additional to the improved weatherability of the present shingle.

The present invention also extends the life of a shingled roof by reducing erosion damage. In principle, a roof is covered by a minimum two layers of shingles except in the area of the underlying shingle exposed by the "cut-outs" of the overlaying shingle. In other words, this exposed area has only a "single" layer of the underlying shingle and if there is no underlayment, then this single layer is directly on the wooden deck. This "exposed" cut-out area of the underlying shingle is very vulnerable to erosion caused by waters cascading down the roof. Generally, most damage occurs in the upper portion of the exposed "cut-out". Any erosion penetration of this area would make the entry for the cascading waters easier to wet the deck and finally find an entry point to the interior of the house.

A further aspect of the invention offers an additional means to protect the vulnerable portion of the underlying shingle. The continuous band 22 as seen in FIGS. 2 and 3 can have strong weathering capability. Polymer modified sealants (i.e., with SBS™), having UV resistant materials may be located such that the portion 25 is visible in the upper regions of the exposed cut-out sections 13 and enhances the resistance of the vulnerable area between the cut-outs to the erosion effects of rain, snow and ice runoff. Thus, by reducing the erosion, the longevity of the shingle is increased.

A sealant, such as SBS modified bitumenous sealant blended with limestone as a filler, is available commercially, for example, as CRAFCO™ #555. Such a sealant will combine the necessary adhesive qualities with a significantly augmented degree of erosion resistance. Other suitable sealants may include, butyl, rubber, acrylic resins, latex rubber, silicones, polyurethanes or other suitable weather-resistant materials.

In addition, the present invention provides enhanced protection of the perforations caused by nailing of the shingles. In the shingle industry generally, manufacturers provide nailing instructions to the roofers (contractors). Invariably, these instructions recommend not to apply nails in the existing stitch pattern adhesive as they would protrude above the sealant surface and prevent bonding of the overlying shingle to the adhesive. Should this happen, it is a weak point that a moderate wind force could then lift the overlying tab of the shingle. Also, because the nails corrode, or due to the expansion and contraction of the main body of the shingle, the hole created by the nail can become enlarged and allow moisture/water to penetrate through to the decking.

However, with the present invention, the nails 21 of the overlying shingle can be positioned in the sealant bead/band area of the underlying shingle (see FIG. 3), such that the sealant will bond to the nail shank. This will retard the rate of corrosion, and, because the sealant is generally softer and more flexible, the effect of the movement of the shingle due to expansion and contraction is marginal. Thus the nail hole remains sealed for a prolonged period, preventing moisture/water intrusion and enhancing the performance and life of the shingle. Furthermore, the more integral and rigid roof system of the present invention, resulting from the two lines of adhesive and sealant attachments, reduces overall movement of flaps and shingles, resulting in reduced stress to the nail/shingle interface.

Figure 4:
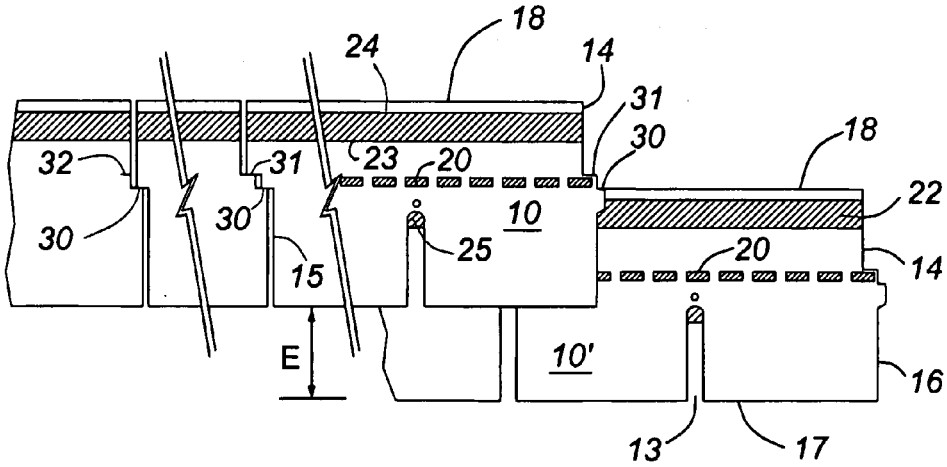
FIG. 4 is a plan view of the positioning indicator applicable to the shingle of the present invention.

In still a further embodiment of the invention, illustrated in FIG. 4, the shingle 10 is provided with spacing indicators which allow the selective positioning of overlying shingles. The spacing indicators allow a conventional size shingle to be installed in a conventional manner, retaining a 2" headlap while gaining the benefit of the additional sealing capability. Alternatively, spacing indicators allow a conventionally sized shingle to be installed with a reduced headlap, allowing greater exposure and greater coverage for the same number of shingles.

Referring to FIG. 4, the side edges 14 and 15 of shingle 10 have first and second stepped notches 30 and 31. When a shingle 10 is laid over an underlying shingle 10', with the lateral notch edge 30 aligned with the head edge 18 of the underlying shingle 10', the exposure (E) is increased. Alternatively, if the lateral edge of notch 31 is aligned with the head edge of an underlying shingle, the exposure is decreased by the distance between the two notches, preferably in the order of ½". This will reduce the exposure (E) by ½") and reproduce the spacing of a traditional shingle with the conventional headlap as required by ASTM, CSA and other standards. A further advantage of the notched edges is the ability to rest or hook a shingle about to be fastened against the notches of an already fastened shingle. This is of particular advantage when the shingles are being laid against a steep roof such as a Mansard roof.

Although stepped notches have been discussed, a tongue and groove notch could be used, or even two parallel slit notches, or any combination of such indicators. For example, to the left of FIG. 4, a single stepped notch 30 (for the enhanced coverage of this invention) may be combined with a slit indicator 32 (the latter, if positioned on top edge 18 of an underlying shingle will reproduce traditional spacing).

Factory application of a continuous (single or multiple), beads or bands of suitable sealant(s) in the upper region of the shingle, as described and illustrated in the Figures, may be accomplished in a manner similar to the conventional manner, where an applicator is dipped in pan containing the "sealant matter". The applicator then transfers the sealant onto the running roof sheeting.

Preferably the sealant is applied in the region bracketing a line located a distance twice the exposure length (i.e. 2 E) from the butt edge of the shingle. A band ½" wide can extend ¼" on either side of the line and achieve all the benefits of this invention along the full length of the shingle. The region is close to the top edge of the shingle but does not extend to the edge. A complementary release tape is applied either on the sealant matter to have a "peel and stick" version or as a release tape complementarily adhered on the back of the shingle, such that when shingles are packaged in a bundle, the sealant bands register directly under the release tape. The release tape prevents sealant from adhering to shingles above it in a package. This latter approach is fairly common in the roofing manufacturing industry.

This invention is applicable to virtually any and all types of shingles of any dimensions.

The roofing shingle of the present invention overcomes leakage or spillage problems resulting from wind driven rain or ice dammed water penetrating beneath and over the shingles by providing a continuous bead or band of sealant adjacent the upper edge of the shingle. Additionally, such a band may be located so that the cut-out portion of an overlying shingle exposes a portion of the band. This exposed portion of band, when selected from appropriate materials, increases the erosion resistance of the shingle to running water.

The foregoing embodiments are illustrative only, and variations in the thickness, pattern and location of the sealant bands and erosion material may be utilized while retaining the benefits of the invention disclosed herein. Similarly, while illustrated in relation to a tabbed shingle, the present invention is equally applicable to slab, overlay and laminated shingles.

The invention claimed is:

1. A roofing shingle for a roofing system of multiple overlapping shingles, the shingle being monoplanar and having a weather-resistant exterior face, opposed side edges and a width extending from a butt edge to a top edge, with an exposed portion of the exterior face having a predetermined width of length E extending from the butt edge and, in use, a covered portion extending from the exposed portion, to the top edge, wherein the width of the shingle is more than twice the length E of the exposed portion;

wherein the covered portion of the shingle is provided with an adhesive strip offset from the butt edge by a distance greater than the length E, the adhesive strip being adapted to adhere to an adjacent shingle; and wherein the covered portion of the shingle is provided with a continuous sealant band parallel to and offset from the top edge, the band having a width extending between a lower imaginary line located no more than the length 2E from the butt edge of the shingle and an upper imaginary line about ¼ inch from the top edge.

2. The shingle of claim 1 wherein the lower imaginary line is located between the length 2E and 2E−1 inch from the butt edge.

3. The shingle of claim 1 wherein the width of the shingle is the length 2E, plus Y where Y is 2 inches or less.

4. The shingle of claim 3 wherein Y is 1 inch or less.

5. The shingle of claim 1 wherein one or more cut-outs extend normal to the butt edge a distance E, thereby defining tabs between the cut-outs.

6. The shingle of claim 5 wherein a portion of the sealant band is adapted to be exposed at the apex of said cut-outs of an overlapping shingle.

7. The shingle of claim 6 wherein the sealant is erosion resistant.

8. The shingle of claim 1 wherein the sealant of the sealant band is a butyl, acrylic, bituminous or modified bituminous composition.

9. The shingle of claim 1 wherein the side edges of the shingle have complimentary spacing indicators.

10. The shingle of claim 9 wherein spacing indicators are notches or slits.

11. The shingle of claim 9 wherein the spacing indicators are offset stepped rectilinear notches.

12. The shingle of claim 11 wherein each side edge has two successively inset rectilinear notches, the first notch located a distance equal to said cut-out length from the butt edge, and the second notch inset further than the first notch at a selected distance above the first notch.

13. The shingle of claim 10 wherein each side edge has two spacing indicators, the first indicator being a notch located a distance equal to said cut-out length from the butt edge, and the second indicator being a slit positioned at a selected distance from the first indicator.

14. The shingle of claim 13 wherein the selected distance is in the range of ½ inch to 1 ½ inch.

15. A roofing shingle for a roofing system of multiple overlapping shingles, the shingle being monoplanar and having a weather resistant exterior faces, opposed side edges and a width extending from a butt edge to a top edge, with a covered portion, in use, extending from the top edge and an exposed portion of the exterior face extending from the butt edge, the exposed portion including at least one cut-out having a length extending perpendicularly across the exposed portion, thereby defining two or more tabs;

wherein the width of the shingle is more than twice said cut-out length; and wherein the exterior face of the shingle is provided with an adhesive strip and a sealant band adapted to adhere the shingle to an overlapping shingle, the strip being discontinuous and aligned on the covered portion parallel to the butt edge above an apex of said cut-out, and the sealant band is continuous being positioned at an imaginary line parallel to and twice the cut-out length from the butt edge.

16. The shingle of claim 15 wherein the width of the shingle is twice the cut-out length, plus a headlap distance.

17. The shingle of claim 16 wherein the headlap distance ranges from ¼ inch to 2 inches.

18. The shingle of claim 16 wherein the headlap distance ranges from ¼ inch to ¾ inch.

19. The shingle of claim 15 wherein at least a portion of the sealant band is offset toward the butt edge of the shingle from the imaginary line.

20. The shingle of claim 19 wherein the sealant band brackets the imaginary line.

21. The shingle of claim 19 wherein the sealant band is parallel to but offset from the top edge of the shingle.

22. The shingle of claim 21 wherein the width of the sealant band is in the range of ¼ inch to 2 inches.

23. The shingle of claim 21 wherein the width of the sealant band is in the range of ½ inch to 1 inch.

24. The shingle of claim 15 wherein the sealant is an erosion resistant composition.

25. The shingle of claim 24 wherein the sealant is a suitable acrylic, butyl, bitumenous or modified bitumenous composition.

26. The shingle of claim 15 wherein the side edges of the shingles have complimentary spacing indicators.

27. The shingle of claim 26 wherein spacing indicators are notches or slits.

28. The shingle of claim 26 wherein the spacing indicators are offset stepped rectilinear notches.

29. The shingle of claim 28 wherein each side edge has two successively inset rectilinear notches, the first notch located a distance equal to said cut-out length from the butt edge, and the second notch inset further than the first notch at a selected distance above the first notch.

30. The shingle of claim 27 wherein each side edge has two spacing indicators, the first indicator being a notch located a distance equal to said cut-out length from the butt edge, and the second indicator being a slit positioned at a selected distance from the first indicator.

31. The shingle of claim 30 wherein the selected distance is in the range of ½ inch to 1 ½ inches.

32. A roofing shingle system comprising multiple overlapping shingles, each shingle having a weather-resistant exposed surface, and a width extending from a butt edge to a top edge and at least one cut-out extending perpendicularly from the butt edge wherein the width of the shingle is at least twice the length of the cut-out, wherein a discontinuous adhesive strip on each shingle extends in a line of spaced adhesive elements offset toward the top edge of the shingle from each apex of each cut-out;

wherein a continuous sealant band on each shingle extends parallel to the top edge of the shingle but offset therefrom, located on an imaginary line at twice the cut-out length from the butt edge of the shingle, the band having a width extending on both sides of said imaginary line; and wherein a portion of the sealant band on each shingle is exposed at each apex of each cut-out of the overlying shingle.

33. The roofing shingle system of claim 32 wherein the sealant band is at least ¼ inch wide.

34. The roofing shingle system of claim 33 wherein the width of the sealant band is between ¼ inch and 1 ½ inches.

35. The roofing system of claim 32 wherein the sealant band is offset from the top edge by a distance sufficient to prevent bleeding of the sealant over the top edge.

36. The roofing system of claim 35 wherein the distance is in the range of ¼ inch to ⅜ inch.

37. A roofing system of multiple associated overlapping shingles, each shingle having a weather resistant exposed surface and having a width extending from a butt edge to a top edge, each shingle having at least one cut-out having a length extending perpendicularly from the butt edge;

wherein the width of the shingle is twice the length of cut-out, plus a headlamp distance Y where Y is a length of 1 inch or less;

and further wherein each shingle has a adhesive strip parallel to and offset towards the top edge by a distance greater than the length of the cut-out from the butt edge of the shingle, and a continuous sealant band positioned on an imaginary line parallel to and at a distance twice the length of the cut-out from the butt edge of the shingle.

38. The roofing shingle system of claim 37 wherein the sealant band is at least ¼ inch wide.

39. The roofing shingle system of claim 38 wherein the width of the sealant band is between ¼ inch and 1 ½ inches.

40. The roofing system of claim 37 wherein the sealant band is offset from the top edge by a distance sufficient to prevent bleeding of the sealant over the top edge.

41. The roofing system of claim 40 wherein the distance is in the range of ¼ inch to ⅜ inch.

42. A method of manufacturing a shingle having a top edge, a butt edge and one or more tabs defined by cut-outs normal to the butt edge and having a length, comprising coating a base member with a granular weather resistant material on the upper surface thereof, applying a discontinuous strip of adhesive to the upper surface, the strip being located a distance greater than the length of the cut-out from the butt edge of the shingle and applying a continuous band of sealant to the upper surface, the band being located a distance generally twice the length of the cut-out from the butt edge of the shingle and offset from the top edge.

43. The method of claim 42 wherein the width of the sealant band brackets an imaginary line at a distance twice of the length of the cut-out from the butt edge of the shingle.

44. The method of claim 43 wherein the width of the sealant band ranges from ¼ inch to 1 ½ inches.

45. The method of claim 42 wherein the offset is at least about ¼ inch.

* * * * *